US008685311B2

(12) United States Patent
Koyama et al.

(10) Patent No.: US 8,685,311 B2
(45) Date of Patent: Apr. 1, 2014

(54) MELT SPINNING METHOD

(75) Inventors: Hiroshi Koyama, Tajimi (JP); Kenta Fujii, Kariya (JP)

(73) Assignee: Toyota Boshoku Kabushiki Kaisha, Aichi-Ken (JP)

( * ) Notice: Subject to any disclaimer, the term of this patent is extended or adjusted under 35 U.S.C. 154(b) by 285 days.

(21) Appl. No.: 13/095,069

(22) Filed: Apr. 27, 2011

(65) Prior Publication Data

US 2011/0285053 A1 Nov. 24, 2011

(30) Foreign Application Priority Data

May 19, 2010 (JP) ..... 2010-115418

(51) Int. Cl.
*D01D 5/084* (2006.01)
*D04H 3/02* (2006.01)

(52) U.S. Cl.
USPC ..... 264/555; 264/103; 264/211.17

(58) Field of Classification Search
USPC ..... 264/103, 210.8, 211.17, 555
See application file for complete search history.

(56) References Cited

U.S. PATENT DOCUMENTS

| | | | | |
|---|---|---|---|---|
| 4,963,298 | A | 10/1990 | Allen et al. | |
| 5,080,569 | A | 1/1992 | Gubernick et al. | |
| 5,098,636 | A | 3/1992 | Balk | |
| 5,124,111 | A | 6/1992 | Keller et al. | |
| 5,160,746 | A | 11/1992 | Dodge, II et al. | |
| 5,695,377 | A | 12/1997 | Triebes et al. | |
| 5,840,633 | A | 11/1998 | Kurihara et al. | |
| 6,001,303 | A | 12/1999 | Haynes et al. | |
| 6,132,661 | A | 10/2000 | Kurihara et al. | |
| 6,247,911 | B1 | 6/2001 | Milligan | |
| 6,248,267 | B1 | 6/2001 | Hosako et al. | |
| 6,495,078 | B1 | 12/2002 | Kurihara et al. | |
| 6,524,521 | B1 | 2/2003 | Kuroiwa et al. | |
| 6,824,729 | B2 * | 11/2004 | Oin et al. | 264/211.17 X |
| 6,877,971 | B2 | 4/2005 | Kurihara et al. | |
| 2002/0117782 | A1 * | 8/2002 | Haynes et al. | 264/555 |
| 2002/0197343 | A1 | 12/2002 | Kurihara et al. | |
| 2003/0056335 | A1 | 3/2003 | Kurihara et al. | |

FOREIGN PATENT DOCUMENTS

| | | |
|---|---|---|
| CN | 1290775 | 4/2001 |
| CN | 1291663 | 4/2001 |
| JP | 4-209862 | 7/1992 |
| JP | 9-279411 | 10/1997 |
| JP | 11-247062 | 9/1999 |
| JP | 2001-98455 | 4/2001 |

OTHER PUBLICATIONS

China Office action, dated Nov. 20, 2012 along with an english translation thereof.

(Continued)

*Primary Examiner* — Leo B Tentoni
(74) *Attorney, Agent, or Firm* — Greenblum & Bernstein, P.L.C.

(57) ABSTRACT

A melt spinning apparatus includes an apparatus body and a nozzle for extruding melted resin, a primary hot air passage formed around the nozzle, and a secondary hot air passage formed in a zone outside of the primary hot air passage, which are formed in the apparatus body. The primary hot air passage discharges primary hot air onto fibers of the melted resin extruded from the nozzle. The secondary hot air passage discharges secondary hot air to maintain the temperature of the primary hot air. The discharge angle of the secondary hot air from the secondary hot air passage is set in a range of 0° to 50° with respect to the direction of the melted resin extruded from the nozzle. The secondary hot air forms an air curtain that blocks the atmospheric air.

5 Claims, 3 Drawing Sheets

(56) References Cited

OTHER PUBLICATIONS

U.S. Appl. No. 13/095,130 to Hiroshi Koyama, which was filed on Apr. 27, 2011.

Japan (JP Appl. No. 2010-115417) Office action, mail date is Jul. 30, 2013.

Japan (JP Appl. No. 2010-115418) Office action, mail date is Jul. 30, 2013.

* cited by examiner

MELT SPINNING METHOD

BACKGROUND OF THE INVENTION

The present invention relates to a melt spinning method and an apparatus used in the method for manufacturing a nonwoven fabric by supplying, onto a conveyor belt, fibers formed by extruding melted resin by using a melt blowing method.

The melt blowing method is a melt spinning method for obtaining a nonwoven fabric sheet from fibers (threads) obtained by melting and extruding raw resin. By the melt blowing method, melted resin is cast into a mold and extruded by an extruder from a nozzle of the mold and, simultaneously, supplied with hot and high velocity airflow from the periphery of the nozzle so that the melted resin may be discharged into fiber shapes (threads). The fibrous resin is supplied onto a conveyor, to manufacture a nonwoven fabric sheet.

As for this type of spinning method, for example, a laterally arranged web manufacturing method is known which is disclosed in Japanese Laid-Open Patent Publication No. 2001-98455. That is, the method includes a step of extruding melted resin from a spinning nozzle into the shape of fibers; a step of discharging hot primary air from the periphery of the open end of the spinning nozzle to vibrate the fibrous melted resin; a step of discharging hot secondary air toward the fibrous melted resin as it vibrates and falls, so that the resin may be spread in a widthwise direction and spun; and a step of laminating the fibrous melted resin onto a conveyor to manufacture laterally arranged webs.

However, the manufacturing method described in the above publication aims at obtaining webs arranged laterally, so that it is necessary to vibrate fibrous melted resin extruded from a spinning nozzle by using primary air and spread it in a widthwise direction by using secondary air. Specifically, a stream of primary air is discharged at a high velocity to form depressurized portions in the peripheral portion of the melted resin in the form of the fibers, which have been extruded from the spinning nozzle, thus vibrating the melted resin. This makes it difficult to orient the molecules of the melted resin in the same direction. The fibers thus have a decreased strength and are easily cut. Further, a stream of secondary air is discharged laterally to the melted resin, thus causing turbulence in the stream of the melted resin in the form of the fibers. The fibers are thus cut easily. As a result, it is difficult to form the melted resin in the form of thin and uniform fibers.

SUMMARY OF THE INVENTION

Accordingly, it is an objective of the present invention to provide a melt spinning method and a melt spinning apparatus that produce melted resin in the form of thin and high-strength fibers easily and stably without cutting the fibers.

To achieve the foregoing objective and in accordance with one aspect of the present invention, a melt spinning method for manufacturing a nonwoven fabric with fibers made of resin is provided. The method includes: extruding melted resin from a nozzle; and blowing hot air toward a periphery of the nozzle in a direction in which the melted resin is extruded during the extruding, thereby forming fibers made of the melted resin. The blowing the hot air includes: blowing a primary hot air from around the nozzle and along the extrusion direction of the melted resin; and blowing a secondary hot air onto the outer periphery of the primary hot air. A discharge angle of the secondary hot air is set in a range of 0° to 50° with respect to the extrusion direction of the melted resin extruded from the nozzle. The secondary hot air forms an air curtain for shielding the primary hot air from the atmospheric air.

In accordance with another aspect of the present invention, a melt spinning apparatus for manufacturing a nonwoven fabric with fibers made of resin is provided. The apparatus includes an apparatus body, a nozzle provided in the apparatus body, a primary hot air passage, and a secondary hot air passage. The primary hot air passage is formed around the nozzle to discharge primary hot air onto the fibers of the melted resin extruded from the nozzle. The secondary hot air passage is formed in a zone outside of the primary hot air passage to discharge secondary hot air for maintaining the temperature of the primary hot air. The melted resin is extruded from the nozzle. When the melted resin is extruded, the primary hot air and the secondary hot air are blown onto a zone around the nozzle, thereby forming fibers made of the melted resin. The primary hot air is discharged from around the nozzle and along a direction in which the melted resin is extruded. The secondary hot air is discharged onto the outer periphery of the primary hot air. The secondary hot air passage is formed in such a manner that the discharge angle of the secondary hot air is set in a range of 0° to 50° with respect to the extrusion direction of the melted resin extruded from the nozzle.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

One embodiment of the present invention will now be described in detail with reference to FIGS. 1 to 3.

Figure 1:
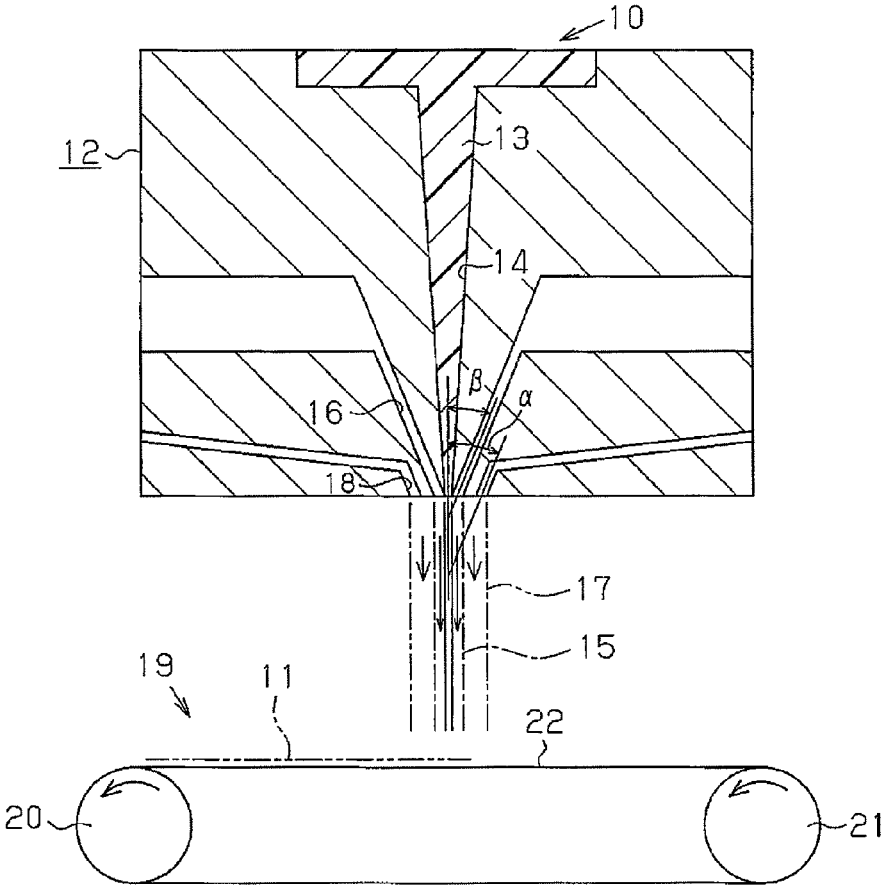
FIG. 1 is a cross-sectional view showing a melt spinning apparatus according to one embodiment of the present invention.
Figure 2:
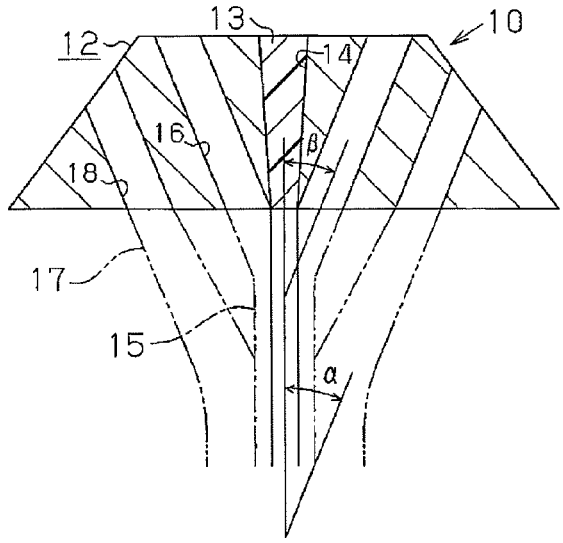
FIG. 2 is an enlarged cross-sectional view showing a main portion of the melt spinning apparatus.

As shown in FIG. 1, a melt spinning apparatus 10 for manufacturing a nonwoven fabric 11 using resin material includes an apparatus body 12 and an elongated nozzle 14 for extruding melted resin 13, a primary hot air passage 16 formed around the nozzle 14 to discharge a primary hot air 15 in a diagonally forward direction, and a secondary hot air passage 18 formed around the primary hot air passage 16 to discharge a secondary hot air 17, which are arranged in the apparatus body 12. The melted resin 13 is extruded from the nozzle 14 of the melt spinning apparatus 10 and formed in the form of fibers (threads) by melting the resin material through a non-illustrated extruder.

The nozzle 14 is formed in a tapered shape having a diameter decreasing toward its open end. The primary hot air passage 16 is sloped and annular such that its diameter decreases toward its open end. The open end of the primary hot air passage 16 is configured in such a manner as to encompass the open end of the nozzle 14. The primary hot air 15 discharged from the primary hot air passage 16 is discharged toward fibers formed by the melted resin 13 extruded from the nozzle 14. The primary hot air 15 is discharged in a manner inclined at the discharge angle β with respect to the extrusion direction of the melted resin 13. The flow velocity of the primary hot air 15 is greater than the flow velocity of the melted resin 13 extruded from the nozzle 14. This discharges the primary hot air 15 toward the stream of the melted resin 13 to extend the fibers of the melted resin 13. As a result, the molecules of the melted resin 13 are oriented in the same direction and the strength of the fibers is thus enhanced. Specifically, the velocity of the primary hot air 15 is set to such a value that the melted resin 13 is prevented from being vibrated by the primary hot air 15.

The secondary hot air passage 18 is arranged around the primary hot air passage 16 and spaced from the primary hot air passage 16 at a predetermined interval. The secondary hot air passage 18 is sloped and annular and has a diameter decreasing toward its open end. The secondary hot air passage 18 has a distal portion extending parallel to the primary hot air passage 16. The secondary hot air 17 is thus discharged in a direction parallel to the primary hot air 15. The secondary hot air 17 forms an air curtain, which shields the primary hot air 15 from the atmospheric air. If the secondary hot air 17 is not discharged parallel to the primary hot air 15, the air curtain effect may not be ensured uniformly around the primary hot air 15.

Although the secondary hot air passage 18 is spaced from the primary hot air passage 16 at the predetermined interval, it is preferable to minimize the interval to configure the secondary hot air passage 18 in such a manner that the secondary hot air 17 is discharged at a position close to the primary hot air 15. Such a configuration allows the secondary hot air 17 to effectively prevent a temperature drop in the primary hot air 15. If the interval between the secondary hot air passage 18 and the primary hot air passage 16 is large, the air in the gap between the primary hot air 15 and the secondary hot air 17 may disadvantageously lower the temperature of the primary hot air 15.

The discharge angle α of the secondary hot air 17 is set in a range from 0° to 50° with respect to the extrusion direction of the melted resin 13 extruded from the nozzle 14. If the discharge angle α of the secondary hot air 17 exceeds 50°, the secondary hot air 17 greatly curves the streams of the primary hot air 15 and the melted resin 13, thus hampering the air curtain function of the secondary hot air 17.

It is also desirable to set the temperature of the secondary hot air 17 to a value higher than the temperature of the primary hot air 15. This prevents a temperature drop in the primary hot air 15, thus maintaining the temperature of the melted resin 13 without decreasing. As a result, the melted resin 13 is extended while maintained at a high temperature, thus creating molecular orientation to form high-strength fibers that are not cut easily. In this case, the temperature of the primary hot air 15 is set low to such an extent that the melted resin 13 is prevented from being degraded.

It is also preferable to set the flow velocity of the secondary hot air 17 to a value lower than the flow velocity of the primary hot air 15. The flow amount of the secondary hot air 17 is set preferably to a value smaller than the flow amount of the primary hot air 15. By setting the flow velocity and the flow amount of the secondary hot air 17 in these manners, the secondary hot air 17 is allowed to effectively function as the air curtain without hampering operation of the primary hot air 15.

In one plane, the nozzle 14, the primary hot air passage 16, and the secondary hot air passage 18 have coaxial openings.

Test results regarding the discharge angle α of the secondary hot air 17, which has been described above, will hereafter be described.

Using the melt spinning apparatus 10 illustrated in FIG. 1, a melt spinning test was conducted with different discharge angles α of the secondary hot air passage 18 with respect to the extrusion direction of the melted resin 13. Specifically, the angle of the primary hot air passage 16 with respect to the extrusion direction of the melted resin 13 from the nozzle 14 was set to 30°. The discharge angle α of the secondary hot air passage 18 with respect to the extrusion direction of the melted resin 13 was varied from 0° to 30°, 45°, 60°, and 90°. In other words, the discharge angle α of the secondary hot air 17 was 0°, 30°, 45°, 60°, and 90° in the melt spinning apparatuses 10 shown in FIGS. 3(*a*), 3(*b*), 3(*c*), 3(*d*), and 3(*e*), respectively. In each drawing of FIGS. 3(*a*) to 3(*e*), an upper half portion is enlarged and a lower half portion is reduced in size.

As the test showed, when the discharge angle α was 0°, as illustrated in FIG. 3(*a*), only slight turbulence occurred in the secondary hot air 17 and the stream of the melted resin 13 extruded from the nozzle 14 descended substantially vertically together with the stream of the primary hot air 15, resulting in effective spinning. When the discharge angle α was 30° as illustrated in FIG. 3(*b*) or 45° as illustrated in FIG. 3(*c*), only a little turbulence occurs in the secondary hot air 17 and the stream of the melted resin 13 extruded from the nozzle 14 descends together with the stream of the primary hot air 15, resulting in generally effective spinning.

Figure 3A:
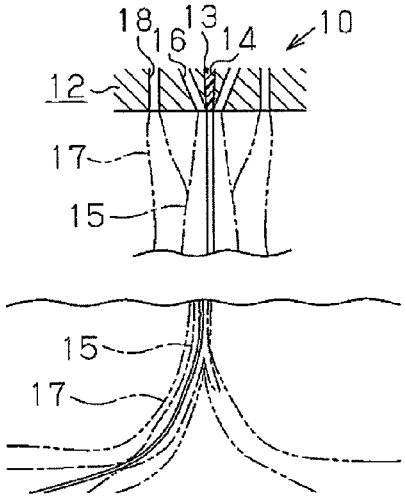
FIGS. 3(*a*), 3(*b*), 3(*c*), 3(*d*), and 3(*e*) are diagrams illustrating streams of melted resin extruded from a nozzle, primary hot air, and secondary hot air in which the discharge angle of the secondary hot air with respect to the flow direction of the melted resin is 0°, 30°, 45°, 60°, and 90°, respectively.
Figure 3B:
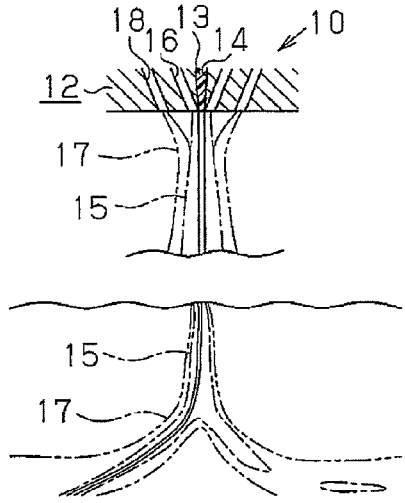
Figure 3C:
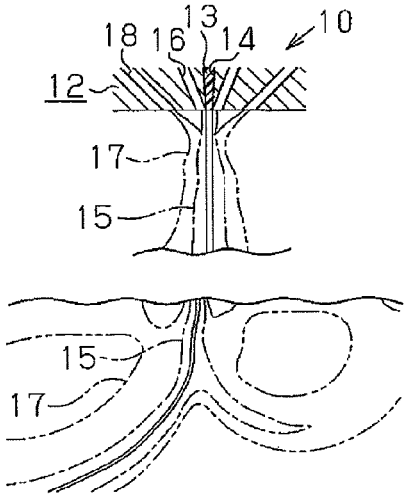
Figure 3D:
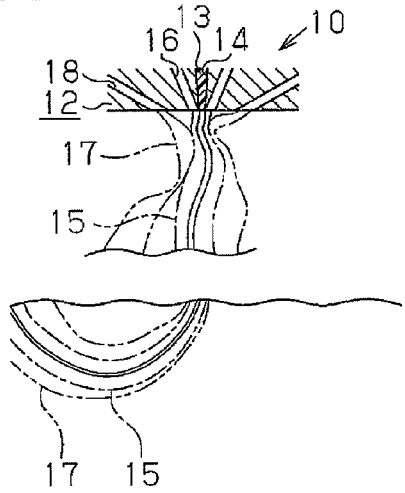
Figure 3E:
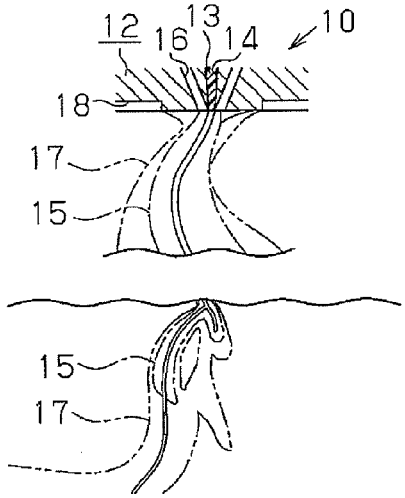

Contrastingly, when the discharge angle α was 60° as illustrated in FIG. 3(*d*) or 90° as illustrated in FIG. 3E, great turbulence occurs in the secondary hot air 17 and the stream of the melted resin 13 extruded from the nozzle 14 and the stream of the primary hot air 15 became curved while descending in a turbulent state, thus hampering desired spinning. As a result, it was made clear that effective melt spinning could be achieved at the middle discharge angle α 50° that is between 45° and 60°.

As shown in FIG. 1, a belt conveyor apparatus 19 is arranged below the melt spinning apparatus 10. A belt 22 is wound around a pair of front and rear rollers 20, 21. The belt 22 revolves on rollers 20, 21. The fibers of the melted resin 13, which are extruded downward from the nozzle 14, are accumulated on the belt 22 to form a sheet of a nonwoven fabric 11.

A melt spinning method for resin using the melt spinning apparatus 10, which is configured as described above, will hereafter be described.

With reference to FIG. 1, when the melted resin 13 is extruded downward from the nozzle 14, the primary hot air 15 is discharged from the primary hot air passage 16 onto the melted resin 13 at the position around the nozzle 14. This extends the melted resin 13 downward to form the fibers and orient the molecules of the melted resin 13 in the same direction. In this state, the secondary hot air 17 is discharged from the secondary hot air passage 18, which is arranged around the primary hot air passage 16, onto the outer periphery of the primary hot air 15. The secondary hot air 17 thus brings about the air curtain effect by which the primary hot air 15 is shielded from the atmospheric air. This prevents a temperature drop in the primary hot air 15, thus maintaining the melted resin 13 at a high temperature. The discharge angle α is set to the range from 0° to 50° with respect to the direction in which the melted resin 13 is extruded from the nozzle 14. This improves the air curtain effect of the secondary hot air 17. As a result, each of the fibers of the melted resin 13 has molecular orientation in which the molecules are oriented in the same direction and thus exhibits improved fiber strength.

The primary hot air 15, which is discharged from the primary hot air passage 16, descends while its flow is adjusted along the stream of the melted resin 13. As a result, the stream of the melted resin 13 extends vertically downward in a stable state wrapped by the stream of the primary hot air 15.

Since the flow velocity of the primary hot air 15 is greater than the flow velocity of the melted resin 13, downward tensile force acts on the melted resin 13, which descends slowly compared to the primary hot air 15, from around the melted resin 13. This extends the fibers of the melted resin 13 in downwardly elongated shapes. The fibers of the melted resin 13 descending together with the stream of the primary hot air 15 are supplied onto the belt 22 of the belt conveyor apparatus 19 and accumulated on the belt 22. This forms a sheet of the nonwoven fabric 11. The obtained sheet of the nonwoven fabric 11 is conveyed to a predetermined position by the belt 22 and thus collected at the predetermined position.

The illustrated embodiment has the advantages described below.

(1) According to the melt spinning method of the illustrated embodiment, the secondary hot air 17 is discharged onto the outer periphery of the primary hot air 15, which is discharged from the zone around the nozzle 14 onto the melted resin 13. The discharge angle α of the secondary hot air 17 is set to the range from 0° to 50° with respect to the extrusion direction of the melted resin 13 from the nozzle 14. As a result, the secondary hot air 17 forms an air curtain that shields the primary hot air 15 from the atmospheric air.

The air curtain effect of the secondary hot air 17 maintains the temperature of the primary hot air 15, thus also maintaining the temperature of the melted resin 13 extruded from the nozzle 14. As a result, significant molecular orientation is observed in the melted resin 13 and high strength of the melted resin 13 is exhibited.

As a result, the melt spinning method of the illustrated embodiment easily and stably provides melted resin in the form of thin and high-strength fibers without cutting the fibers.

(2) The secondary hot air 17 is discharged parallel to the primary hot air 15. This causes the secondary hot air 17 to form a uniform air curtain with respect to the primary hot air 15 at the position spaced from the primary hot air 15 at a certain interval. The primary hot air 15 is thus shielded effectively from the atmospheric air.

(3) The temperature of the secondary hot air 17 is set higher than the temperature of the primary hot air 15. This prevents a temperature drop in the primary hot air 15 and maintains the melted resin 13 at a high temperature. As a result, the melted resin 13 is prevented from solidifying and allowed to exhibit sufficient molecular orientation in each of the fibers, thus improving the physical properties of the fibers such as the strength.

(4) The flow velocity of the secondary hot air 17 is set lower than the flow velocity of the primary hot air 15. Alternatively, the flow amount of the secondary hot air 17 is set smaller than the flow amount of the primary hot air 15. This decreases the influence on the flow velocity or the flow amount of the primary hot air 15, thus optimizing the air curtain effect of the secondary hot air 17 without hampering the effect of the primary hot air 15.

(5) The secondary hot air 17 is discharged at the position close to the primary hot air 15. The primary hot air 15 is thus shielded from the atmospheric air by the heat retained by the secondary hot air 17. This effectively prevents a temperature drop in the primary hot air 15.

(6) The melt spinning apparatus 10 has the nozzle 14 for extruding the melted resin 13, the primary hot air passage 16 for discharging the primary hot air 15 onto the melted resin 13, and the secondary hot air passage 18 for discharging the secondary hot air 17, which are arranged in the apparatus body 12. The secondary hot air passage 18 is set in such a manner that the discharge angle α of the secondary hot air 17 falls in the range of 0° to 50° with respect to the extrusion direction of the melted resin 13, which is extruded from the nozzle 14. As a result, the melt spinning apparatus 10 provides melted resin in the form of thin and high-strength fibers easily and stably by means of a simple configuration, without cutting fibers.

(7) The primary hot air passage 16 is sloped with respect to the nozzle 14 and the secondary hot air passage 18 extends parallel to the primary hot air passage 16. This configuration discharges the primary hot air 15 onto the melted resin 13 to extend the fibers of the melted resin 13 and ensures the air curtain effect of the secondary hot air 17.

The illustrated embodiment may be modified to the forms described below.

Figure 4:
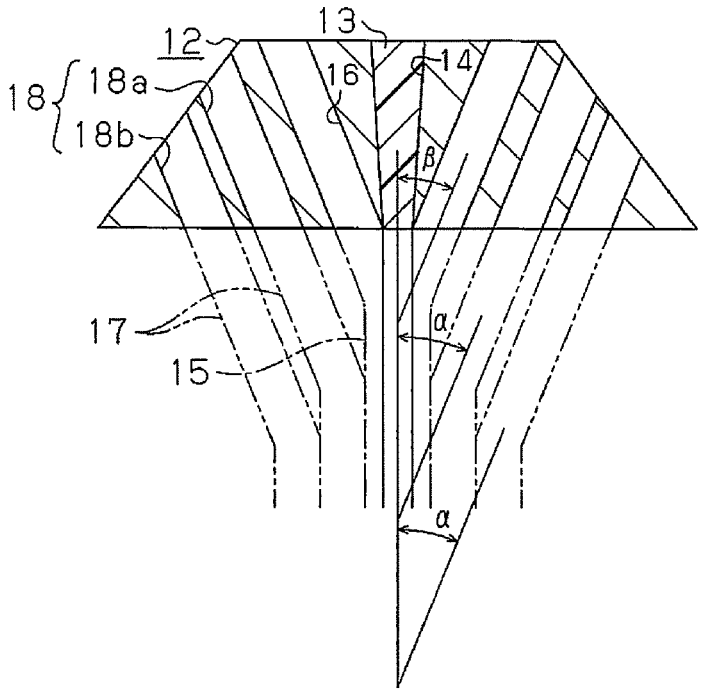
FIG. 4 is a cross-sectional view showing a main portion of a melt spinning apparatus according to a modified embodiment.

As illustrated in FIG. 4, the secondary hot air passage 18 may have a double structure including a first secondary hot air passage 18*a* and a second secondary hot air passage 18*b*. In this case, the properties such as the temperatures, the flow amounts, and the flow velocities of the secondary hot air 17 in the first secondary hot air passage 18*a* and the secondary hot air 17 in the second secondary hot air passage 18*b* may be changed as needed. According to this embodiment, the air curtain effect of the secondary hot air 17 is improved.

It is preferable to set the discharge angle β of the primary hot air 15 to the range of 0° to 50° with respect to the extrusion direction of the melted resin 13, which is extruded from the nozzle 14. It is also preferable to match the discharge angle β of the primary hot air 15 with the discharge angle α of the secondary hot air 17.

In the above illustrated embodiment, the discharge angle β of the primary hot air 15 is set to 30° with respect to the extrusion direction of the melted resin 13, which is extruded from the nozzle 14, in the above-described test. However, the discharge angle β of the primary hot air 15 is not restricted to 30° but may be changed to other angles including 20° and 40°.

The temperature of the primary hot air 15 may be equal to the temperature of the secondary hot air 17. In this case, a common hot air may be used as the primary hot air 15 and the secondary hot air 17.

To improve the air curtain effect of the secondary hot air 17, the communication area of the secondary hot air passage 18 may be increased to raise the flow amount of the secondary hot air 17 compared to the flow amount of the primary hot air 15.

The nozzle 14 has a tapered shape having a diameter that decreases toward its open end. However, the taper angle of the nozzle 14 may be changed. Alternatively, the nozzle 14 may be shaped like a uniform cylinder.

Therefore, the present examples and embodiments are to be considered as illustrative and not restrictive and the invention is not to be limited to the details given herein, but may be modified within the scope and equivalence of the appended claims.

What is claimed is:

1. A melt spinning method for manufacturing a nonwoven fabric with fibers made of resin, the method comprising:

extruding melted resin from a nozzle; and blowing hot air toward a periphery of the nozzle in a direction in which the melted resin is extruded during the extruding, thereby forming fibers made of the melted resin, wherein the blowing the hot air includes:

blowing a primary hot air from around the nozzle and along the extrusion direction of the melted resin; and blowing a secondary hot air onto the outer periphery of the primary hot air such that the secondary hot air is blown in a direction parallel to the blown primary hot air, wherein a discharge angle of the secondary hot air is set in a range of 0° to 50° with respect to the extrusion direction of the melted resin extruded from the nozzle, the secondary hot air forming an air curtain for shielding the primary hot air from the atmospheric air.

2. The melt spinning method according to claim 1, wherein a temperature of the secondary hot air is set higher than a temperature of the primary hot air.

3. The melt spinning method according to claim 1, wherein a flow velocity of the secondary hot air is set lower than a flow velocity of the primary hot air.

4. The melt spinning method according to claim 1, wherein a flow amount of the secondary hot air is set smaller than a flow amount of the primary hot air.

5. The melt spinning method according to claim 1, wherein the secondary hot air is discharged at a position adjacent to the discharged primary hot air so as to prevent a temperature change in the primary hot air.

* * * * *